US007281578B2

(12) United States Patent
Nakajima et al.

(10) Patent No.: US 7,281,578 B2
(45) Date of Patent: Oct. 16, 2007

(54) APPARATUS AND METHODS FOR POSITIONING IN A BOREHOLE

(75) Inventors: Hiroshi Nakajima, Sagamihara (JP); Atsushi Enomoto, Tokyo (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 182 days.

(21) Appl. No.: 10/871,098

(22) Filed: Jun. 18, 2004

(65) Prior Publication Data

US 2005/0279498 A1 Dec. 22, 2005

(51) Int. Cl.
*E21B 23/00* (2006.01)
*E21B 23/08* (2006.01)

(52) U.S. Cl. ..... 166/255.2; 166/382; 166/383; 166/66

(58) Field of Classification Search ..... None
See application file for complete search history.

(56) References Cited

U.S. PATENT DOCUMENTS

| | | | | |
|---|---|---|---|---|
| 2,815,578 | A | 12/1957 | Douglas | |
| 2,946,130 | A | 7/1960 | Edward et al. | |
| 4,056,004 | A | 11/1977 | Roesner | |
| 4,500,146 | A * | 2/1985 | Peterson | 312/257.1 |
| 4,563,757 | A | 1/1986 | Decorps et al. | |
| 4,566,535 | A * | 1/1986 | Sanford | 166/113 |
| 4,673,890 | A * | 6/1987 | Copland et al. | 33/544.2 |
| 4,715,440 | A | 12/1987 | Boxell et al. | |
| 4,979,585 | A | 12/1990 | Chesnutt et al. | |
| 5,086,645 | A | 2/1992 | Deaton | |
| 5,785,125 | A | 7/1998 | Royer | |
| 2002/0108487 | A1 | 8/2002 | Yuratich et al. | |

FOREIGN PATENT DOCUMENTS

| | | |
|---|---|---|
| EP | 0 452 044 | 10/1991 |
| GB | 2372273 | 8/2002 |

OTHER PUBLICATIONS

Reeves Technologies, "Compact Two-Arm Caliper-MTC", undated.

* cited by examiner

*Primary Examiner*—Frank Tsay
(74) *Attorney, Agent, or Firm*—Karan Singh; Jaime Castano; Dale Gaudier

(57) ABSTRACT

A borehole tool positioning and measuring apparatus and its methods of use are provided. The apparatus and method can be used to centralize a logging tool in a wellbore, or position a logging tool at a desired relative alignment relative to the wellbore perimeter surface. The method and apparatuses can be used to determine useful information regarding borehole size and configuration. Various embodiments are useful for centralizing, eccentralizing, and otherwise positioning a borehole tool in a wellbore. Methods of determining borehole size and configuration measurements using a positioning apparatus are also provided.

68 Claims, 11 Drawing Sheets

APPARATUS AND METHODS FOR POSITIONING IN A BOREHOLE

FIELD OF THE INVENTION

This invention relates to an apparatus for positioning and measuring in a borehole and methods of use thereof. It further relates an apparatus for gauging a borehole and methods to provide caliper measurements.

BACKGROUND OF THE INVENTION

Numerous borehole logging methods and tools are known to provide many kinds of borehole data. One important aspect of borehole logging is the physical alignment of the tool with the borehole. Operation of some types of borehole tools require centralization of the tool in the wellbore, operation of other types of borehole tools require eccentric positioning in the wellbore, and other types of borehole tools are preferentially operated when in contact with the wellbore surface.

Apparatuses are known to position a borehole tool centrically, eccentrically, or in other preferential alignment within a wellbore. A positioning apparatus also may be used to position a borehole tool at a preferred distance from the surface of the wellbore perimeter or to position a borehole tool against the wellbore perimeter surface. The use of a positioning apparatus may be particularly important when the borehole tool is sensitive to the tool standoff, the offset between the tool and the wall of the well bore. Types of apparatus known to be used for positioning include linked arm, leaf spring, bow spring, coil spring and various combinations thereof.

Positioning a borehole tool within a wellbore can be difficult. Some wellbores may be irregular when drilled. In others, the wellbore perimeter surface configuration may be affected by collapse, encroachment, or wash-out of earth formations. These conditions result in a wellbore that is not ideally circular or uniform. Similarly, in a deviated well the wellbore varies from uniformly circular owing to non-vertical geometry. Often boreholes having a non-circular perimeter are referred to as having a "short-axis" and a "long-axis". Known symmetric positioning devices are poorly adapted to use in wellbore having a non-circular or non-uniform perimeter. Thus an apparatus capable of positioning a borehole tool in a non-circular or non-uniform wellbore, as well as a circular or uniform wellbore is desirable.

Some well logging sondes, such as those providing density or microresistivy measurements, are equipped with extra springs to ensure contact of sensor pads with the wellbore. In these sondes, the springs may be arranged so that the potential energy of the total spring system is minimized when the sonde is aligned along the "short axis" of the wellbore. Such known systems have limitations however as they are not adjustable nor can the system performance or contact pressure able to be monitored.

When logging in a borehole, it is useful to know the wellbore size and configuration. Methods are known to estimate wellbore size by processing and interpreting data acquired by logging tools or by estimating borehole size from information such as drill bit size, drilling rate, fluid pressure and expected formation parameters. These methods however provide an estimate rather that a direct measurement. Direct measurement of borehole size using mechanical or acoustic calipers is known. But the expense and effort required to log a borehole with a separate caliper is disadvantageous. A positioning apparatus that can provide direct measurements of the borehole during logging tool operation would provide operational advantages.

When performing logging operations with multiple logging tools disposed in a borehole on same tool string, some tools may require centralization while other tools may require a different preferred alignment in the wellbore. In other situations, it may be desired to log a borehole more that once, using the same borehole tool with different alignments in the borehole. It would be expedient for well site operations if the same apparatus could be configured and used to provide various preferred alignments of a logging tool in a borehole. It would be advantageous for operations if a plurality of the same positioning apparatus could be used to position a plurality of borehole tools in a tool string. It would be particularly useful if one of the plurality of positioning apparatus could be configured centralize a tool while another of the plurality of positioning apparatus could be configured to another tool eccentrically in the borehole. A positioning apparatus that can be configured and used flexibly to position as desired in a borehole is needed.

In deviated wells, proper alignment of a borehole tool in a wellbore can be particularly difficult as the wellbore typically varies from uniformly circular owing to its non-vertical geometry. In addition, in a deviated wellbore, the weight of the borehole tool itself will tend to position the tool off-center. Known symmetric positioning devices are poorly adapted for use in non-vertical boreholes. Thus an apparatus capable of positioning a borehole tool in circular and non-circular wellbore is desirable.

SUMMARY OF THE INVENTION

The present invention provides a borehole tool positioning and measuring apparatus and its methods of use. In one aspect, the present invention is used to centralize a logging tool in a wellbore. In another aspect the present invention is used to position a logging tool at a desired relative alignment relative to the wellbore perimeter surface. In another aspect, the present invention can be used to determine useful information regarding borehole size and configuration. There are other objects and applications of the present invention that will become apparent in the following disclosure.

The present invention provides a positioning apparatus for locating borehole tools in a wellbore and methods for use thereof. Various embodiments of the present invention are useful for centralizing, eccentralizing, and otherwise positioning a borehole tool in a wellbore. The present invention further provides methods of determining borehole size and configuration measurements using a positioning apparatus.

According to an aspect of the invention, an apparatus is provided for positioning in a borehole comprising a body; a plurality of arms, each arm independently extendable and independently retractable; a push rod connected to each arm, each push rod in operational contact with a spring sheet; and a resilient spring mechanism having one end in contact with the spring sheet.

According to another aspect of the invention an apparatus for positioning in a borehole is provided comprising a body; a first arm connected to a first push rod in operational contact with a first spring sheet; a second arm connected to a second push rod in operational contact with a second spring sheet; and a resilient spring mechanism, wherein the first spring sheet contacts one end of the resilient spring mechanism and the second spring sheet contacts the opposite end of the resilient spring mechanism.

According to another aspect of the invention an apparatus for positioning in a borehole is provided comprising an elongate body; a plurality of arms, each arm connected to a separate push rod; a drive rod; a motor capable of providing force to the drive rod; and at least one resilient spring mechanism in operational contact with the drive rod and positioned to act upon at least one push rod.

According to another aspect of the invention a borehole caliper tool is provided comprising an elongate body a drive rod; a motor capable of providing force to the drive rod; and a plurality of arm systems, each arm system comprising an arm capable of being extended outwardly from the apparatus body, pivotally connected to a push rod, the push rod being in contact with a sensor, and a resilient spring mechanism positioned to act upon the push rod and in operational contact with the drive rod.

According to another aspect of the invention an apparatus for use in a borehole is provided comprising a plurality of arms; and a quick closing mechanism comprising at least one lever pivotally connected to a mounting and an opposing push rod for moving the lever about the pivot, wherein the quick closing mechanism is positioned to operate upon at least one of the plurality of arms.

According to another aspect of the invention a method for positioning a tool in borehole is provided comprising the steps of deploying in a borehole an apparatus, the apparatus comprising a body; a plurality of arms, each arm independently extendable and independently retractable; a push rod connected to each arm, each push rod in operational contact with a spring sheet; a resilient spring mechanism having one end in contact with the spring sheet, and contacting the wellbore perimeter surface with at least one arm.

According to another aspect of the invention a method for positioning a tool in borehole is provided comprising the steps of deploying in a borehole an apparatus, the apparatus comprising an elongate body; a plurality of arms, each arm connected to a separate push rod; a drive rod; a motor capable of providing force to the drive rod, and at least one resilient spring mechanism in operational contact with the drive rod and positioned to act upon at least one push rod; activating motor to move drive rod to operationally contact at least one push rod; and moving at least one push rod to extend at least one arm to contact a borehole perimeter surface.

According to another aspect of the invention a method for measuring a borehole is provided comprising deploying in a wellbore a borehole apparatus comprising an elongate body a drive rod, a motor capable of providing force to the drive rod, and a plurality of arm systems, each arm system comprising an arm capable of being extended outwardly from the apparatus body, pivotally connected to a push rod, the push rod being in contact with a sensor, and a resilient spring mechanism positioned to act upon the push rod and in operational contact with the drive rod; sensing separately an initial position of each arm using a sensor, thereby generating an initial position signal for each arm; extending the arms to contact a borehole surface; sensing separately the extended position of each arm using a sensor; generating an extended position signal for each arm; and processing the initial position signals and the extended position signals to gauge the borehole surface.

BRIEF DESCRIPTION OF THE DRAWINGS

The advantages of the present invention will become apparent from the following description of the accompanying drawings. It is to be understood that the drawings are to be used for illustration only and not considered as a definition of the invention or limiting of its scope.

Figures 1A, 1B:
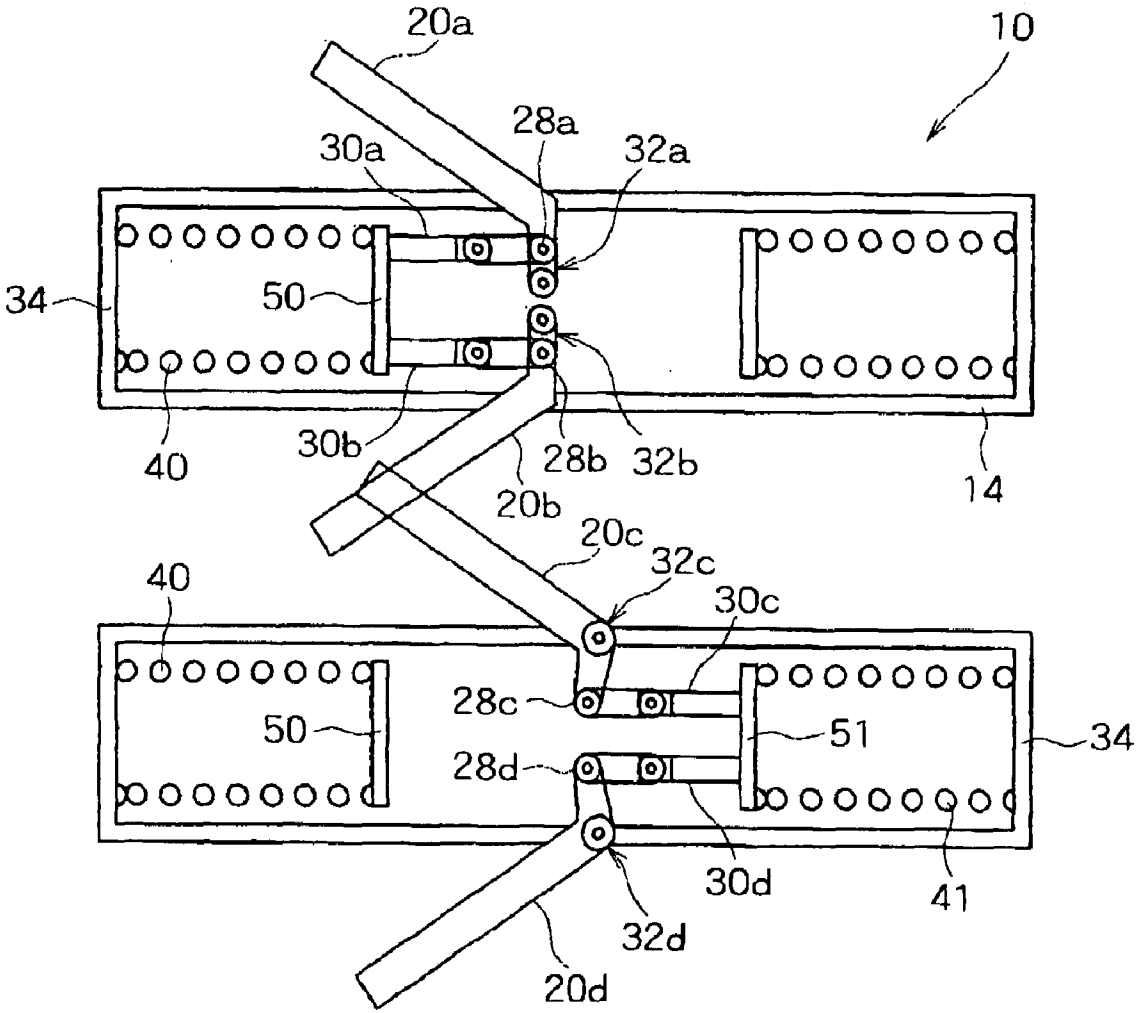
FIGS. 1*a* and 1*b* shows an embodiment of a positioning apparatus of the present invention.

Throughout the drawings, identical reference numbers and descriptions indicate similar, but not necessarily identical elements. While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modification, equivalents and alternatives falling within the scope of the invention as defined by the appended claims.

DETAILED DESCRIPTION

In FIG. 1*a*, positioning apparatus 10 comprises arm 20*a* shown connected to push rod 30*a* and arm 20*b* shown connected to push rod 30*b*. Push rods 30*a* and 30*b* contact spring sheet 50 which contacts one end of resilient spring mechanism 40. One type of suitable resilient spring mechanism is a coil spring. The other end of spring 40 is fixed. As used herein, fixed refers to being restricted from movement, examples of how this restriction occur include but are not limited to fastening in place or abutting an immovable structure such as illustrated by stop 34. In the configuration shown, arms 20*a* and 20*b* are extended when spring 40 is in its neutral state or in some embodiments when spring 40 is provided in a pre-compressed state. During deployment in borehole, extended arms 20*a* and 20*b* contact the wellbore perimeter surfaces. Arm 20*a* rotates about fulcrum 32*a* and moves push rod 30*a* via connector 28*a*. Arm 20*b* rotates about fulcrum 32*b* and moves push rod 30*b* via connector 28*b*. The force applied on arms 20*a*, 20*b* by contact with the borehole wall pushes rods 30*a*, 30*b* and, via spring sheet 50, is transferred to spring 40. When the contact forces are greater than the resistance of spring 40, spring 40 compresses, and arm 20*a*, 20*b* retract pivotally about fulcrum 32*a*, 32*b* respectively toward the apparatus body 14. In this configuration, arms 20*a* and 20*b* retract and extend as a pair. Arms 20*c* and 20*d* shown in FIG. 1*b* are placed in a complimentary orientation to arms 20*a* and 20*b*. One example orientation is shown in FIG. 1*b* where arm pair 20*c* and 20*d* is orthogonally to arm pair 20*a* and 20*b*. Arms pair 20*c* and 20*d* function similarly to arm pair 20*a*, 20*b*. Initially arms 20*c* and 20*d* are extended and spring 41 is in its neutral state. Springs 40 and 41 may have the same or different spring constants. When arm 20*c* contacts the wellbore perimeter surface, the contact force is transferred to resilient spring mechanism 41 via spring sheet 51 being pushed by push rod 30*c*, the force being transferred about fulcrum 32*c* to push rod 30*c* via connector 28*c*. When arm 20*d* contacts the wellbore perimeter surface, the contact force is transferred to spring 41 via spring sheet 51 as pushed by rod 30*d*, the force being transferred from arms 20*d* about fulcrum 32*d* to push rod 30*d* via connector 28*d*. Each arm pair 20*a*, 20*b* and arm pair 20*c*, 20*d* can extend or retract independently from the other arm pair. Note that, as used herein the terms "retract", "retractable" include members that are retractable due to forces external to the apparatus, such as from the force of pushing against the borehole wall. Arm pair 20*a*, 20*b* and arm pair 20*c*, 20*d* can be extended the same or a different distance from away from the apparatus body. In some embodiments and for some uses, such as centralizing, it may be preferred to utilize springs 40 and 41 that have the same or similar spring constants. In other embodiments, such as for use in "short-axis" boreholes, it may be preferred to utilize springs 40 and 41 that have different spring constants.

When a tool is placed in a non-circular borehole, it tends to settle in a position aligned with the "long-axis" of the borehole. This "long-axis" is likely to be uneven and rugose; data acquired from measurements along such a "long-axis" tend to be of poorer quality. A technique known as "short-axis logging" can be used in non-circular boreholes. As the borehole wall tends to be fairly smooth in the short-axis region of the borehole, a tool aligned with the "short-axis" typically will produce measurements of better quality than a tool aligned with the "long-axis". To ensure contact of pads of well logging sondes, such as those producing density or microresistivity logs, with the "short-axis", sondes previously have been equipped with extra springs, arranged so that the potential energy of the total spring system is minimized when the sonde is aligned along the "short axis". An operational disadvantage of such systems however is they cannot be adjusted nor can the performance of such system be monitored in a borehole.

It is noted that while some embodiments described herein illustrate two arms, it is clearly contemplated within the scope of the present invention to use two or more arms. Further while the positioning apparatus has been in illustrated in a separate apparatus body 14, it is also contemplated within the scope of this invention to provide the positioning apparatus within the overall body of a borehole tool being deployed and without a separate housing surrounding the positioning apparatus only.

Figure 2:
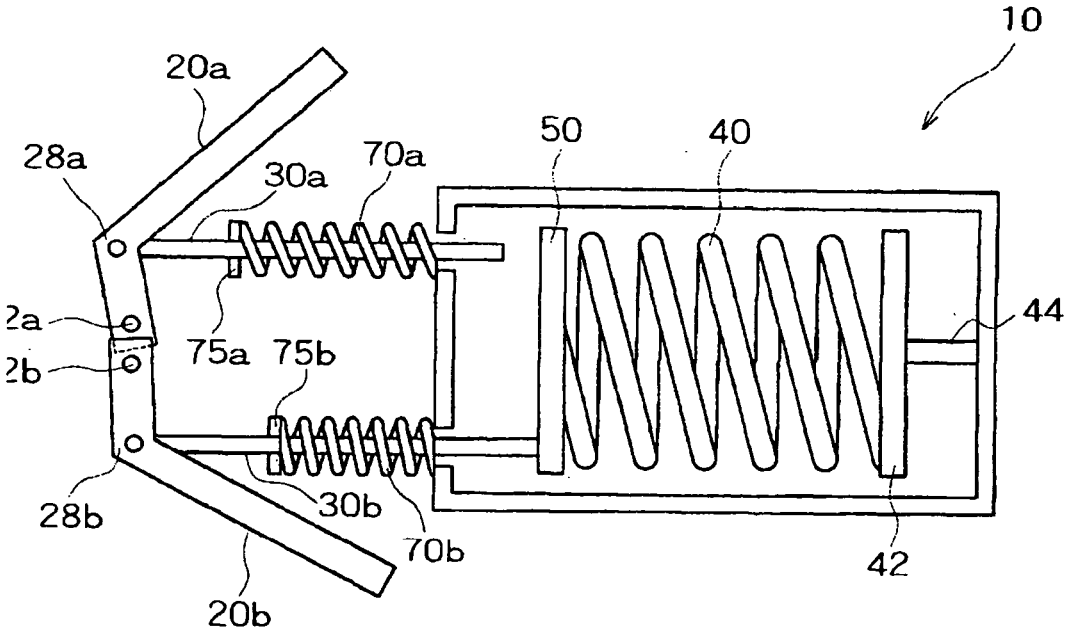
FIG. 2 shows a compact embodiment of the present invention comprising subsprings.

Turning to FIG. 2, another embodiment of positioning apparatus 10 comprises resilient biasing means 70*a*, 70*b* disposed on rods 30*a*, 30*b* connected to arms 20*a*, 20*b*. Suitable types of resilient biasing include subsprings, coil springs and disc springs. By making the unloaded spring lengths long compared to their compression at maximum contact force, the contact forces for all arms can be similar even for widely differing arm expansions such as typically found when the tool is off-centered. In this embodiment, arms 20*a* and 20*b* are independent of each other and do not retract and extend as a pair. Subsprings 70*a* and 70*b* may have the same or different spring constants. When arm 20*a* contacts the wellbore perimeter surface, the contract pressure on arm 20*a* transfers about fulcrum 32*a* to rod 30*a* via connector 28*a*, causing rod 30*a* to move. Movement of rod 30*a* is resisted by subspring 70*a*. Subspring 70*a* is constrained by fixed end sheet 75*a*. In some embodiments, the location of end sheet 75*a* is fixed using moveable pins, thereby permitting the location of end sheet 75*a* to be adjusted to compress or release subspring 70*a*.

Whenever the contact force on arm 20*a* is less than the resistance of subsprings 70*a*, rod 30*a* does not contact spring sheet 50. When the contact pressure on the arm 20*a* is greater than the resistance provided by subspring 70*a*, rod 30*a* moves to contact spring sheet 50 and spring sheet 50 moves to compress resilient spring mechanism 40. Spring sheet 42 is in contact with threaded peg 44. Threaded peg 44 may be adjusted to press spring sheet 42 compresses resilient spring mechanism 40 or threaded peg 44 may be adjusted to permit spring sheet 42 to retract from resilient spring mechanism 40 thereby permitting the resilient spring mechanism 40 to extend.

When arm 20*b* contacts the wellbore perimeter surface, the contract pressure on arm 20*b* transfers about fulcrum 32*b* to rod 30*b* via connector 28*b*, causing rod 30*b* to move. Movement of rod 30*b* is resisted by subspring 70*b*. Subspring 70*b* is constrained by fixed end sheet 75*b*. In some embodiments, the location of end sheet 75*b* is fixed using moveable pins, thereby permitting the location of end sheet 75*b* to be adjusted to compress or release subspring 70*b*.

When the contact force on arms 20*b* is less than the resistance of subsprings 70*b*, rod 30*b* does not contact spring sheet 50. When the contact pressure on the arm 20*b* is greater than the resistance by provided by subspring 70*b*, rod 30*b* moves to contact spring sheet 50 and spring sheet 50 moves to compress spring 40. If neither rod 30*a* or rod 30*b* contact spring sheet 50, spring 40 is in neutral position and spring sheet 50 is approximately perpendicular to the axis of spring 40. In some embodiments, spring 40 may be deployed in positioning apparatus 10 in a pre-compressed state and positioned such that spring sheet 50 remains in constant contact with either one or both rods 30*a*, 30*b*. In this manner, either one or more arms 20*a*, 20*b* can be deployed in an outwardly extended position, the level of pre-compression of the spring affecting the amount of outward extension of the arms. In the configuration, pre-compressed spring 40 exerts a force via spring sheet 50 on either one or more rods 30*a*, 30*b* to extend either one or more arms 20*a*, 20*b*. When the contact force on arm 20*a* is greater than the resistance provided by subspring 70*a* and the contact pressure on arm 20*b* is greater than the resistance provided by subspring 70*b* by approximately the same amount, rods 30*a* and 30*b* push spring sheet 50 about equally and spring sheet 50 remains approximately perpendicular to the axis of resilient spring mechanism 40. Compression on spring 40 is approximately uniform and resistance by spring 40 is applied approximately equally across spring sheet 50. As a result, the resistance force is applied about equally to arms 20*a*, 20*b* by rods 30*a*, 30*b* in contact with the spring sheet 50. Arms 20*a*, 20*b* extended or retract approximately equally.

When the contact force on arm 20*b* is greater than resistance of subspring 70*b* but the contact pressure on arm 20*a* is not greater than resistance of subspring 70*a* then only rod 30*b* applies a force to spring sheet 50. Spring sheet 50 compresses spring 40 and arm 20*b* retracts. When contact force on arm 20*a* is greater than resistance of subspring 70*a* and contact force on arm 20*b* is greater than resistance of subspring 70*b*, but the contact forces are not approximately equal, rods 30*a* and 30*b* apply different forces to spring sheet 50. Spring 40 is compressed non-uniformly and spring sheet 50 does not remain approximately perpendicular to the axis of spring 40. Assuming the greater force is being exerted by rod 30*a*, the portion of compression spring 40 in the vicinity of the rod 30*a* is more compressed, causing the spring sheet 50 to angle toward the rod 30*b*. Arm 20*a* retracts in response to the compression of spring 40 and the movement of spring sheet 50.

When the contact forces on arms 20*a*, 20*b* are each greater than the resistance of sub-springs 70*a*, 70*b* respectively, then both rods 30*a* and 30*b* apply forces to spring sheet 50 to compress spring 40. While FIG. 2 is shown with a pair of opposing arms for convenience, it is understood that a plurality of arms may be used in this embodiment, each arm functioning as described heretofore for arms 20*a* and 20*b*.

It can be appreciated that the present invention may be configured with resilient biasing means having the same or different resistance. In one instance, the subsprings may have the same stiffness such that the push rods of each arm contact the spring sheet when the same force is applied to each arm. Alternatively, subsprings with different spring constants may be used such that contact of the push rod with the spring sheet occurs at different forces for different arms. Similarly the present invention may be configured with varying differences in stiffness between resilient biasing means and the resilient spring mechanism. Furthermore, such configurations may be particularly applicable when positioning apparatus 10 is deployed in a deviated or non-vertical wellbore such that selected arms extend outwardly more stiffly for positioning against a borehole wall while other arms are configured to move more freely, permitting those arms to remain in contact with the borehole wall as the positioning apparatus is moved in the wellbore. In some embodiments, one or more sensors may be provided on one or more arms. In a particular embodiment, sensors are placed on arms configured to more freely along the borehole wall, thereby providing a caliper measurement of the borehole.

Figure 3A:
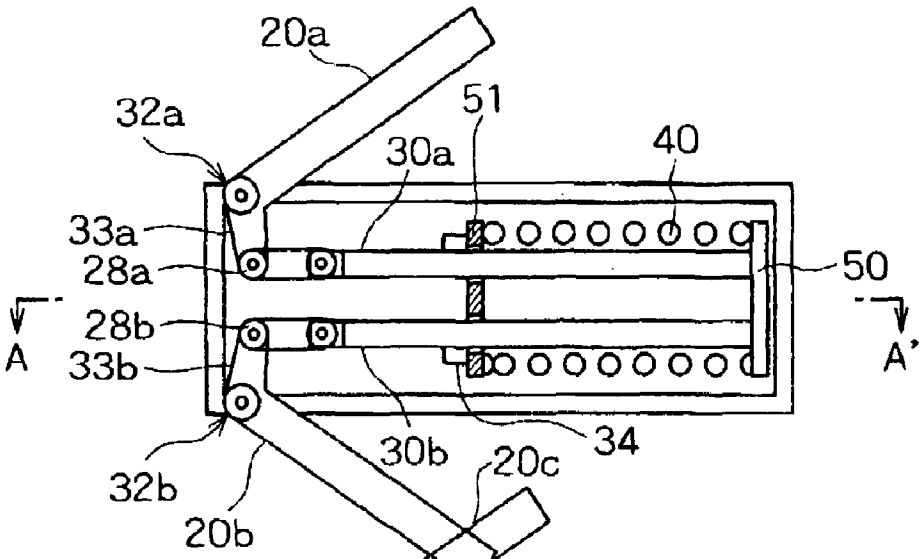
FIGS. 3*a* and 3*b* show another compact embodiment of a positioning apparatus.
Figure 3B:
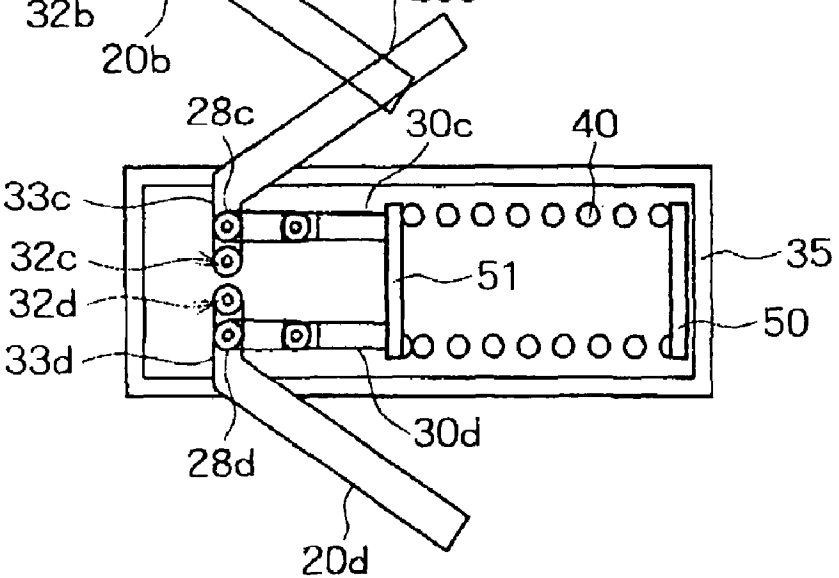

A compact embodiment of the positioning apparatus that comprises resilient biasing means and two pairs of arms is illustrated in FIGS. 3*a* and 3*b*. FIG. 3*b* shows a cross sectional view along the line A–A' in FIG. 3*a*. Turning to FIGS. 3*a* and 3*b*, arms 20*a*, 20*b* form an opposing pair and arms 20*c*, 20*d* form an opposing pair. As arm 20*a* contacts the wellbore perimeter surface, force is transferred about fulcrum 32*a* connected to link 33*a*, link 33*a* being connected via connector 28*a* to rod 30*a*. As arm 20*b* contacts the wellbore perimeter surface, force is transferred about fulcrum 32*b* connected to link 33*b*, link 33*b* being connected to rod 30*b* via connector 28*b*. Rods 30*a* and 30*b* are connected to spring sheet 50. As spring 40 compresses, it presses on and is resisted by spring sheet 51. Movement of spring sheet 51 is limited in one direction by stop 34.

As the arm 20*c* contacts the wellbore perimeter surface, force is transferred about fulcrum 32*c* connected to link 33*c*, link 33*c* being connected to rod 30*c* via connector 28*c*. As the arm 20*d* contacts the wellbore perimeter surface, force is transferred about fulcrum 32*d* connected to link 33*d*, link 33*d* being connected to rod 30*d* via connector 28*d*. Rods 30*c* and 30*d* are connected to spring sheet 51; types of suitable connections include mechanical connectors such as pins and bolts and physical connections such as welds and forms. As force is applied to arms 20*c*, 20*d*, spring sheet 51 depresses spring 40. As spring 40 compresses, it presses spring sheet 50. Movement of spring sheet 50 is limited in one direction by stop 35. In this manner, borehole contact force causing retraction of one pair of arms 20*a*, 20*b* is transferred via movement of rods and compression of spring 40 to extend the other pair of arms 20*c*, 20*d* within the overall limits of movement of spring sheets 50 and 51 within the range of movement defined by the distance between stops 34 and 35. Embodiments of the present invention such as illustrated in FIGS. 3*a* and 3*b* provide a compact positioning apparatus wherein only a single spring 40 is required.

The effective resistance of spring 40 can be increased or decreased through any number of ways to adjust the extent to which arms 20 extend or retract. For example, a spring with a greater or lesser spring constant may be provided. Another embodiment comprises providing reactive springs. A further embodiment comprises adjustable reactive springs.

Figure 4A:
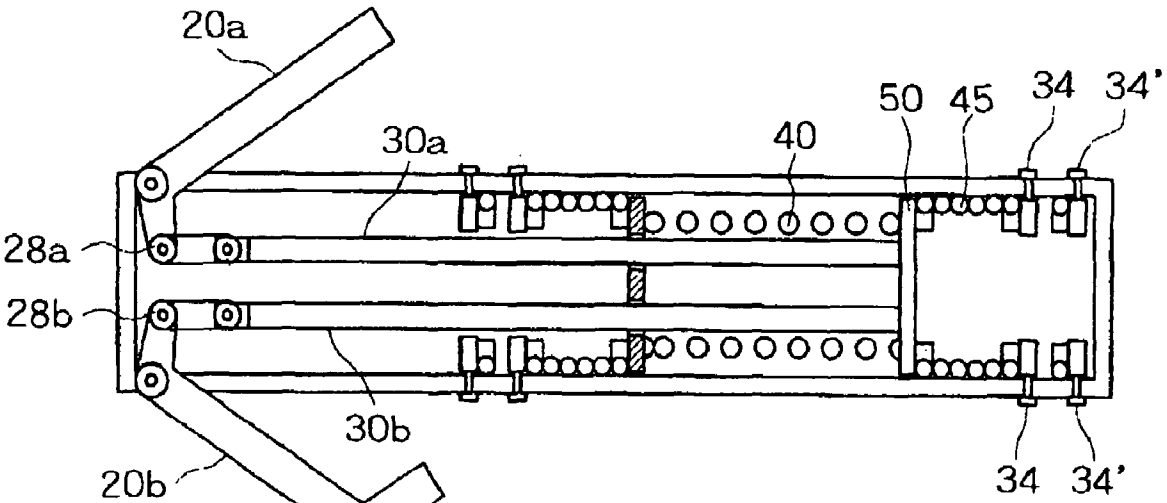
FIG. 4*a* shows an adjustable embodiment of the present invention.

FIG. 4*a* shows another embodiment comprising a pair of arms 20*a* and 20*b*. Arm 20*a* connects to rod 30*a* via connector 28*a* and arm 20*b* connects to rod 30*b* via connector 28*b*. Both rods 30*a* and 30*b* contact spring sheet 50. Reactive spring 45 is connected to the reverse side of spring sheet 50. Reactive spring 45 is secured by stop 34. Contact force on arm 20*a* from the wellbore perimeter surface causes rod 30*a* to move spring sheet 50 to compress spring 40. Contact force on arm 20*b* from the wellbore perimeter surface causes rods 30*b* to move spring sheet 50 to compress spring 40. Movement of spring sheet 50 and compression of spring 40 is resisted by reactive spring 45. In an embodiment, the degree of resistance to movement of the spring sheet 50 provided by reactive spring 45 can be adjusted by moving the location of stop 34, thereby compressing or extending reactive spring 45. As means of illustration, stop 34 could be moved to stop 34' to extend reactive spring 45.

Figure 4B:
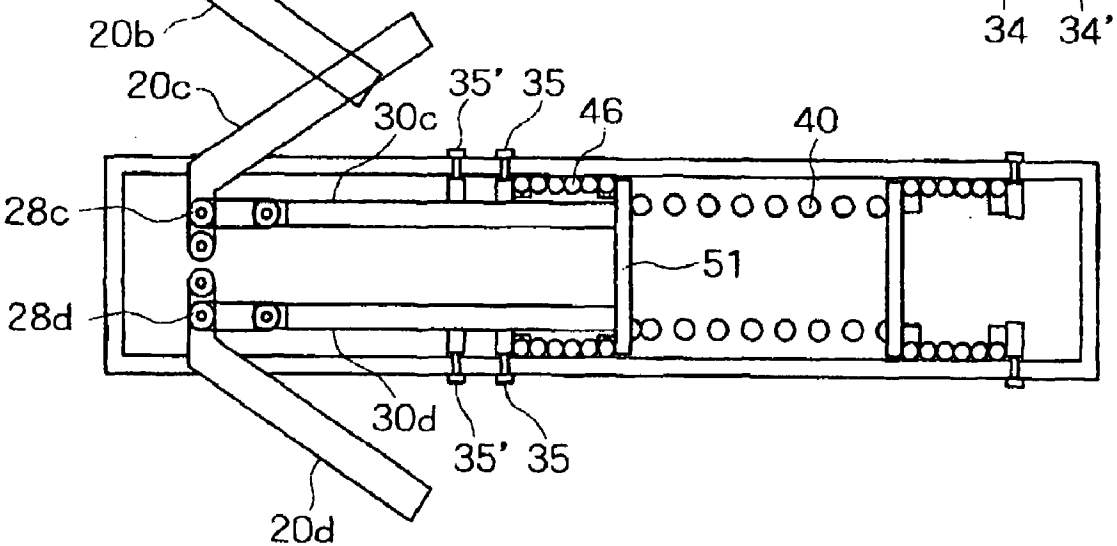
FIG. 4*b* illustrates a further embodiment of a positioning apparatus of FIG. 4*a*.

FIG. 4*b* illustrates how a further embodiment comprising a second pair of arms 20*c* and 20*d*. Arm 20*c* connects to rod 30*c* and arm 20*d* connects to rod 30*d*. Both rods 30*c* and 30*d* contact spring sheet 51. Reactive spring 46 is connected to the reverse side of spring sheet 51. The opposite end of reactive spring 46 is fixed by stop 35. Contact force on arm 20*c* from the wellbore perimeter surface causes rod 30*c* to push spring sheet 51 thereby compressing spring 40. Contact force on arm 20*d* from the wellbore perimeter surface causes rod 30*d* to push spring sheet 51 thereby compressing spring 40. Movement of spring sheet 51 and compression of spring 40 is resisted by reactive spring 46. The degree of resistance to movement of the spring sheet provided by the reactive spring 46 can be adjusted by compressing or extending reactive spring 46 by moving the location of stop 35. As means of illustration, stop 35 could be moved to stop 35' to extend reactive spring 46.

As a borehole tool string is moved to descend or ascend within the wellbore, arms 20 may be maintained in a retracted position by a covering mechanism such as a linkage frame, link arm, leaf spring or bow spring. It is contemplated within the scope of this invention that arms 20 may directly contact the wellbore surface or arms 20 may contact the interior surface of the bow spring or linkage frame with the exterior surface of the bow spring or linkage frame contacting the wellbore perimeter surface. Such configurations are contemplated in the present invention and do not subtract from the spirit or scope thereof. It is also noted that the wellbore perimeter surface may be the borehole wall, casing or any other element forming the interior surface of the borehole annulus.

Figure 5A:
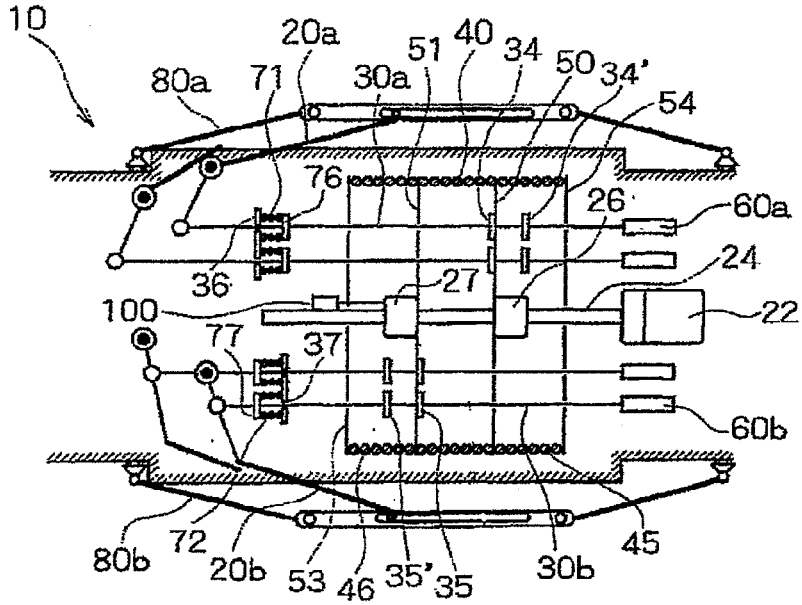
FIGS. 5*a* through 5*d* illustrate a motorized embodiment of the present invention.
Figure 5B:
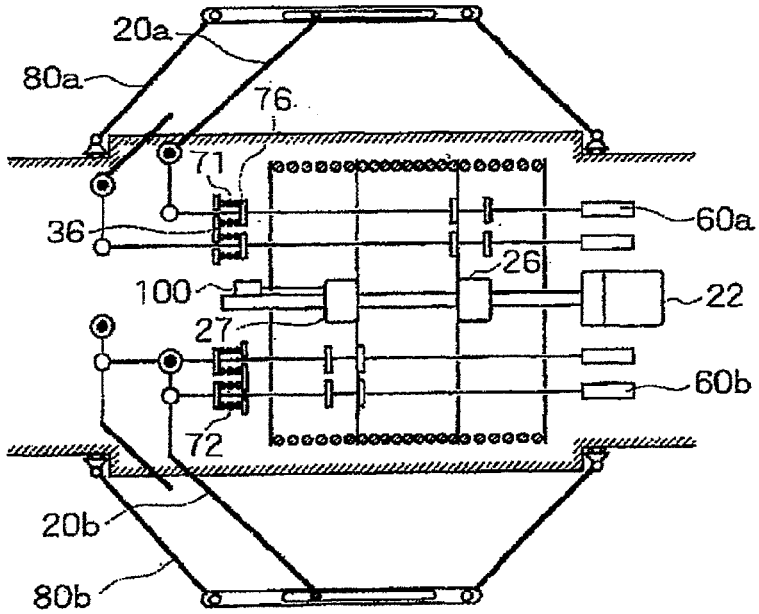
Figure 5C:
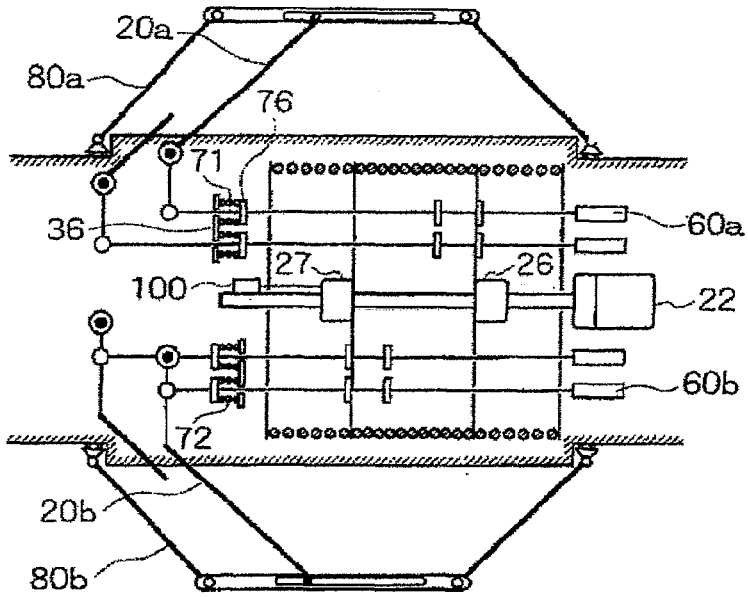
Figure 5D:
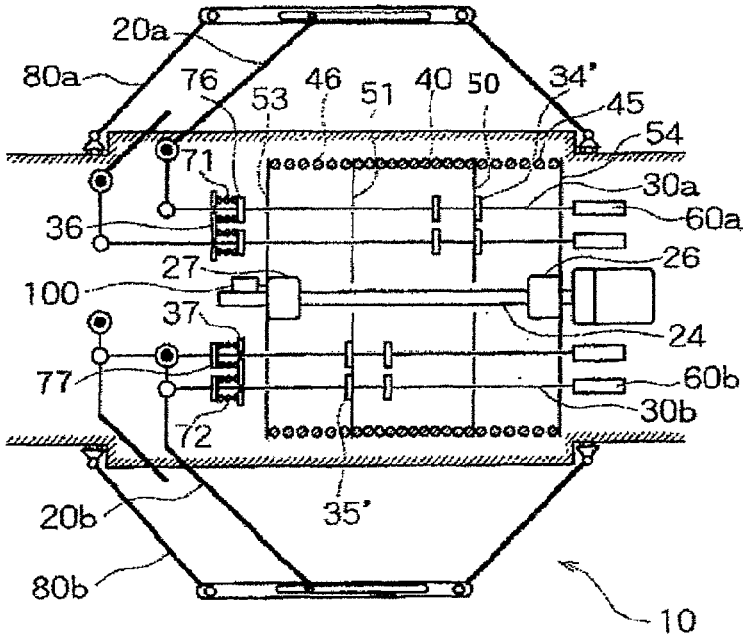

Turning to FIGS. 5*a*–5*d*, embodiments of the present invention are shown in which a motor 22 is provided. In FIG. 5*a*, positioning apparatus 10 is shown with positioning arms 20*a*, 20*b* retracted, such configuration being useful for example when positioning apparatus 10 is being run into or pulled out of a borehole. In FIG. 5*d*, positioning apparatus 10 is shown with motor 22 operating to fully extend positioning arms 20*a*, 20*b*. Configurations for intermediate positioning between retracted (FIG. 5*a*) and fully extended (FIG. 5*d*) are shown in FIGS. 5*b* and 5*c*. In FIG. 5*b*, positioning arms 20*a*, 20*b* are shown extended by biasing means 71, 72 only while in FIG. 5*c*, positioning arms 20*a*, 20*b* are shown extended in response to a combination of the forces exerted by biasing means 71, 72 and spring 40.

In the embodiments shown in FIGS. 5*a*–5*d*, reactive spring 45 is provided initially in a neutral state (free height) between spring sheets 54 and 50, reactive spring 46 is provided initially in a neutral state (free height) between spring sheets 51 and 53, and spring 40 is provided initially in pre-compressed state against spring sheets 50 and 51. In use, the state of reactive springs 45, 46 and spring 40 varies in response to operation of positioning apparatus 10. It is apparent that using springs having varied spring constants, or substituting springs having differing spring constants to adapt positioning apparatus 10 for use in a various borehole configurations in contemplated within the scope of the present invention and disclosure.

In FIGS. 5*a* through 5*d*, optional linkage frames 80*a* and 80*b* are shown. Arm 20*a* is interior to and in contact with linkage frame 80*a* and arm 20*b* is interior to and in contact with linkage frame 80*b*. In this configuration, linkage frames 80*a* and 80*b* are extendable to contact the wellbore perimeter surface. It is understood that the present invention does not require the use of covering mechanisms such as linkage arms 80*a*, 80*b* and, if used, any type or combination of such covering mechanism may used with the present invention.

An individual arm may move in the following fashion. Arm 20*a* is connected to rod 30*a* and rod 30*a* extends to sensor 60*a*. Sensor 60*a* detects the relative position of rod 30*a*, thereby detecting the extent to which arm 20*a* is extended or retracted. Examples of suitable sensors include linear potentiometers or linear variable differential transducers (LVDT). Sensor 60*a* can act as a stop when adjusted to restrict the extent to which an arm can extend or retract. Disposed upon rod 30*a*, biasing means 71 is fixed on one end by stop 36 and contacts end sheet 76 on the other end. An example of a biasing means is a spring. Depending upon which end is fixed, depressing biasing means 71 may apply a tensile or compressive force to rod 30*a*. Biasing means 71 are shown as subsprings although use of any appropriate biasing means is contemplated within the scope of the invention.

For convenience herein, an arm upon which a biasing means 71 applies a tensile force is referred to as a tension arm and an arm upon which a biasing means 71 applies a compressive force is referred to as a compression arm. As an example, arm 20*b* is shown as a compression arm. Arm 20*b* is connected to rod 30*b*. Disposed upon rod 30*b*, biasing means 72 is fixed on one end by stop 37 and contacts end sheet 77 on the other end.

In this way, arms are independently moveable. It is thus possible to have one arm pushed inwardly by the surrounding material more than another arm. The plurality of arms in this embodiment may include any combination of tension and compression arms, including all compression arms or all tension arms.

FIG. 5*a* illustrates a configuration of an embodiment of the positioning apparatus with the arms 20 closed, such as may be used when deploying the borehole tool into the wellbore or retrieving the borehole tool from the wellbore. In the configuration shown in FIG. 5*a*, tensile subspring 71 applies a tensile force to rod 30*a* and compression subspring 72 applies a compressive force to rod 30*b*.

Motor 22 controls movement of arms between a retracted position (illustrated by FIG. 5*a* ) and an extended position (illustrated by FIG. 5*d* ). Motor 22 provides linear motion to symmetric coupling rod 24 whereupon coupling elements 26 and 27 are provided on coupling rod to effect contact with spring sheets. Rotation of coupling rod 24 causes rectilinear movement of the coupling elements 26 and 27. One example of a type of symmetric coupling rod is a reversible ball screw and an example of coupling elements are include ball nuts. Coupling elements 26 and 27 are placed on coupling rod 24 such that rotating coupling rod 24 may move coupling element 26 to contact spring sheet 50 or coupling element 27 to contact spring sheet 51. This force applied to spring sheet 50 or 51 in turn compresses or expands spring 40, retracting or extending arms 20*a* and 20*b*. Sensor 100 (LVDT or potentiometer) is used to determine desired position of nut.

A particular embodiment wherein the coupling rod 24 is a symmetric ball screw and coupling elements 26, 27 are internally geared ball nuts is now described. When positioning apparatus 10 is at a depth in the borehole desirable for placement, motor 22 is activated to apply torque to screw 24 having nuts 26 and 27 disposed thereon. Nut 26 is disposed on screw 24 between spring sheets 54 and 50. The range of movement of spring sheet 50 is limited by stops 34 and 34'. Nut 27 is disposed on screw 24 between spring sheets 51 and 53. The range of movement of spring sheet 51 is limited by stops 35 and 35'. Screw 24 extends along the axis of spring 40 and reactive springs 45 and 46. One end of reactive spring 45 is fixed to spring sheet 54 and the other end of reactive spring 45 is fixed to spring sheet 50. One end of reactive spring 46 is fixed to spring sheet 51 and the other end of reactive spring 46 is fixed to spring sheet 53. Rotation of screw 24 by motor 22 moves nuts 26 and 27.

FIG. 5*d* illustrates an embodiment useful to place a positioning apparatus of the present invention in a location in a wellbore. In the fully-extended configuration shown, nut 26 is disposed adjacent to spring sheet 54 at its outermost limit and pulling spring sheet 50 toward spring sheet 54 until spring sheet 50 contacts stop 34', thereby extending reactive spring 45. In doing so, spring sheet 50 extends spring 40. In some embodiments, spring 40 is pre-compressed initially, such that spring 40 pushes spring sheet 50, 51 until spring sheet 50, 51 contacts stop 34' and 35' when nut 27 and 26 release compression of 40 for arm retraction. Therefore sheet 50 contacts stop 34' by the force generated by spring 40 before nut 26 contacts to sheet 54 and start extending the spring 45. Before nut 26 contacts sheet 54, only spring 40 acts on the arm rod. After nut 26 contacts to sheet 54, springs 40 and 45 act on the arm rod. Nut 27 is disposed adjacent to spring sheet 53 at its outermost limit and pulling spring sheet 51 toward spring sheet 53 until spring sheet 51 contacts stop 35', thereby extending reactive spring 46. Arm 20*a* is interior to and in direct contact with linkage frame 80*a* and is extended to contact the wellbore perimeter surface. Arm 20*b* and linkage frame from 80*b* are extended to contact the wellbore perimeter surface.

A configuration of positioning apparatus 10 with the arms extended such as shown in FIG. 5*d*, would be useful when positioning a borehole tool in a wellbore. Arm 20*a* is connected to rod 30*a* and rod 30*a* extends to sensor 60*a*. Sensor 60*a* detects the relative position of rod 30*a*, thereby detecting the extent to which arm 20*a* is extended or retracted. Disposed upon rod 30*a*, subspring 71 is fixed on one end by stop 36 and contacts end sheet 76 on the other end. Tensile subspring 71 is fixed on one end and may apply a tensile force to rod 30*a*. Arm 20*b* is connected to rod 30*b* and rod 30*b* extends to sensor 60*b*. Sensor 60*b* detects the relative position of rod 30*b*, thereby detecting the extent to which arm 20*b* is extended or retracted. Disposed upon rod 30*b*, subspring 72 is fixed on one end by stop 37 and contacts end sheet 77 on the other end. Compression subspring 72 may apply a compressive force to rod 30*b*.

The embodiment illustrated in FIG. 5*d* shows positioning apparatus 10 in a configuration useful for centralizing a borehole tool. Arms 20*a* and 20*b* are extended approximately equally. Reactive springs 45 and 46 are approximately the same stiffness. In this configuration, the overall positioning apparatus 10 operates efficiently. Subspring 71 applies tensile force to rod 30*a* and arm 20*a*, and spring sheet 50 shown adjacent to stop 34' pulls spring 45 and pushes spring 40. Subspring 72 applies compressive force to rod 30*b* and arm 20*b*, and spring sheet 51 shown adjacent to stop 35' pulls spring 46 and pushes spring 40.

Included in the scope of the present invention are other embodiments of positioning apparatus 10. In one alternative, subspring 71 may be configured to provide tensile forces to rods 30*a* and subspring 72 may be configured to provide tensile forces to rods 30*b*, or both subsprings may be configured to provide compressive forces to their respective rods. Reactive springs 45 and 46 may have similar or different spring constants and be similar or different lengths. Arms 20*a* and 20*b* may have the same or different lengths.

While illustrated with two arms, it can be appreciated that any plurality of arms may be provided. For example, in an embodiment, four arms may be provided spaced approximately 90 degrees about the positioning apparatus. Alternatively six arms may be provided and spaced approximately 60 degrees about the positioning apparatus. In this configuration, each arm may extend and retract independent of the other arms. Alternatively certain arms may paired such that borehole forces on the pair cause the retraction of one arm and the extension of the opposing arm.

In an embodiment, stops 34' or 35' may be a pin having a certain non-symmetric configuration and an opening may be provided on spring sheet 50 or 51 respectively, the opening being the same non-symmetric configuration. When it is desired to not permit arm 20*a* to contact the borehole wall, rod 30*a* is rotated to permit stops 34' to align with the opening on spring sheet 50 thereby permitting stops 34' to pass through spring sheet 50 (Non-powered position). When it is desired to permit arm 20*a* to contact the borehole wall, rod 30*a* is rotated such that stop 34' is not aligned with the opening in spring sheet 50, thereby applying pressure to spring 40 via spring sheet 50 (Powered position).

In another embodiment, certain arms may be permitted to extend further from the tool than other arms. This embodiment is particularly useful in an eccentric wellbores such as a wellbore with an approximate elliptical shape with major and minor axis. Embodiments of the present invention are useful in such boreholes. For example, arms may be provided wherein a set of opposing arms are arranged so that rod 30*a* is rotated such that stop 34' is not aligned with the opening in spring sheet 50, thereby applying pressure to spring 40 via spring sheet 50 while another set of opposing arms are at a different arrangement so that rod 30*b* is rotated that stop 35' is aligned with the opening in spring sheet 51. In this configuration, the positioning device of the present invention may be used to in an elliptical borehole perimeter. When nut 26 and 27 is arranged in the powered position as shown in FIGS. 5*c* and 5*d*, the spring force of 40 (and 45) is applied to rod 30*a* only while rod 30*b* is opening with force of subspring 72 only. The opposing arms 20*a* only having a large opening force thus those arms are stabilized in the major axis in the borehole.

Figure 6:
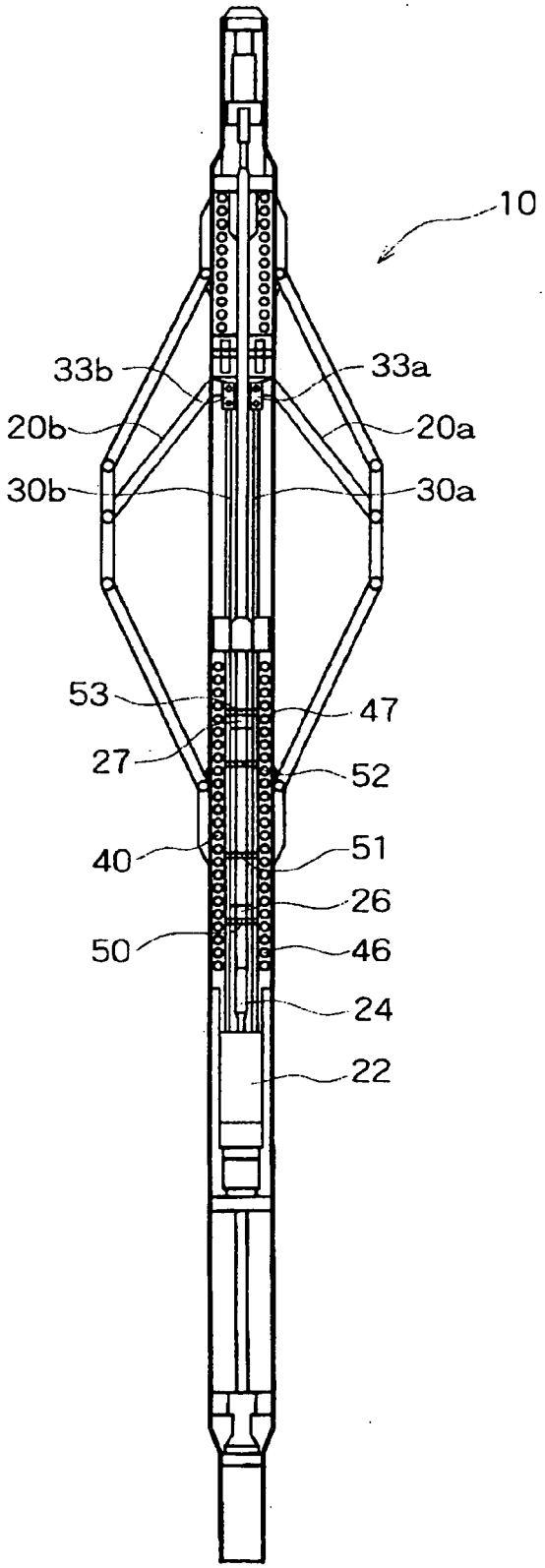
FIG. 6 shows another motorized embodiment of the present invention.

FIG. 6 illustrates an embodiment of the present invention. Positioning apparatus 10 comprises a plurality of arms, for example arms 20*a*, 20*b*, and arms 20*c*, 20*d* (not shown on FIG. 6) located transversely to arms 20*a* and 20*b*. Each arm 20*a*, 20*b*, 20*c*, 20*d* is connected to a rod 30*a*, 30*b*, 30*c*, 30*d* respectively (rods 30*c* and 30*d* are not shown). Links (33*a*, 33*b* shown in FIG. 6) may be used to provide this connection. In this configuration, each arm is retractable or extendable independently from each other arm. Two-arm, four-arm, and six-arm configurations may be of particular use in various borehole applications, although any number of arms may be used in the present invention. In some embodiments, certain arms may be of a different length or may be extended a different distance from the apparatus body than other arms. In some applications, it may be advantageous to operate opposing arms as a pair.

At either end or both ends of the positioning apparatus, a connector may be provided for making electrical and mechanical connections between the positioning apparatus and an adjacent component. Electrical connections of the tool via an electrical connector and transferred along the body of the tool may be provided in a known manner.

Arms 20 may be expanded using a variety of mechanisms or combinations thereof. When the positioning apparatus is used as a caliper, for example, the arms may be expanded under the force of the sub-spring only. Alternatively, when used as a centralizer, the arms may be expanded under the difference of the forces applied by the sub-spring and compression spring. In other centralizer applications, the arms may be expanded under the force of the compression spring only. Further, the various expansion mechanisms may be used in combination. For example, if an eccentric alignment is desired, selected arms may be expanded under the sub-spring force only while other arms may expanded under force applied by the compression spring. In non-motored embodiments, by changing the location of various stops, the springs may be compressed or expanded, thereby altering force applied to the arm. In motorized embodiments, the ball screw drives nuts in operational contact with spring sheets to compress springs or to permit springs to expand.

Springs 40, 41, 45, and 46, and operation of motor 22 in motorized embodiments, control the extension and retraction of arms 20. The rods cause movement of the arms by means of links pivotally connected at the end of the rods and pivotally connected to the end of the arms. In a non-motorized configuration, the positioning force of each arm can be adjusted mechanically by stop 34 to extend or relax spring 45.

In motorized embodiments of the present invention, motor 22 controls movement of arms 20*a*, 20*b*, 20*c*, and 20*d* between a retracted position toward the body of positioning apparatus 10 and an extended position away from the body of positioning apparatus 10. Motor 22 provides linear motion to symmetric coupling rod 24 whereupon coupling elements 26 and 27 are provided on coupling rod to effect contact with spring sheets. In FIG. 6, the symmetric coupling rod is shown as ball screw and coupling elements 26 and 27 are shown as nuts. Rotation of ball screw 24 causes rectilinear movement of the nuts 26 and 27. Nuts 26 and 27 are placed on ball screw 24 such that rotating ball screw 24 moves nut 26 to contact spring sheet 51 or nut 27 to contact spring sheet 52. This force applied to spring sheet 51 or 52 in turn compresses or expands spring 40, retracting or extending arms 20*a* and 20*b* as desired by operating motor 22 in a forward or reverse mode. In one embodiment, the threads on ball screw 24 can be reversed on opposite ends of the screw such that nuts 26 and 27 move in opposite directions when ball screw 24 rotates. In this embodiment, nuts 26 and 27 move toward each other such that spring sheets 51 and 52 compress spring 40. By rotating screw 24 furthermore nut 26 contact spring sheet 50 after away from 51 and nut 27 contact spring sheet 53 after away from 52 then extend spring 45 and 46 respectively to maximize arm pressure.

A position sensor measures the position of the rod, or more specifically in some embodiments, the position of the ball nut relative to the rod. Typically one end of the position sensor is fixed relative to the body and the other end acts as a first end stop of the rod. The position of each arm is indicated by its respective potentiometer and that position information is transmitted back to the surface, transmitted to a downhole telemetry cartridge, recorded into data storage, or otherwise monitored or recorded. In this way, an operator or a control mechanism can reduce or increase the pressure of the arms against the borehole by operating the motor in the appropriate direction. In some embodiments, the control mechanism comprises a control system that monitors a pressure sensor at the end of each arm and automatically adjusts the position of an arm based on the contact pressure with the wellbore. A relative bearing sensor, such as an inclinometer, maybe provided to measure tool orientation in the borehole.

Figure 7A:
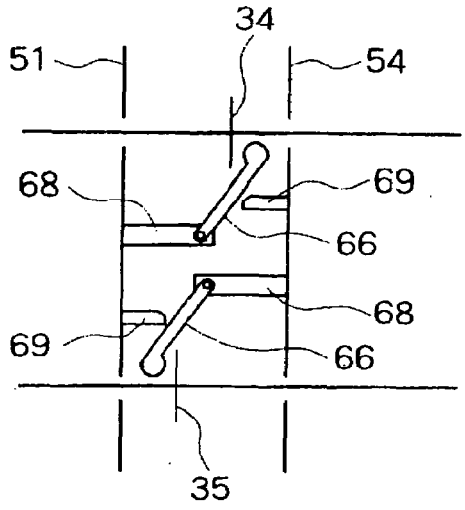
FIGS. 7*a*-7*c* illustrate a quick-release mechanism useable in the present invention.
Figure 7B:
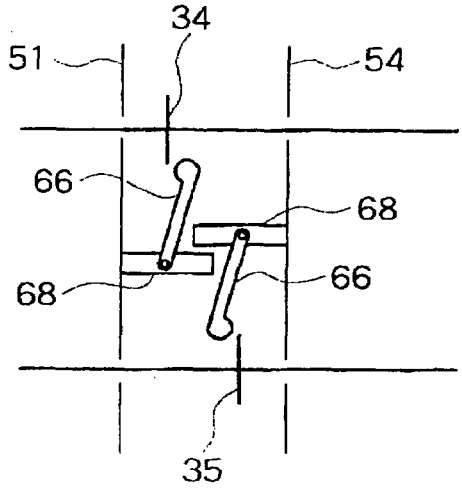
Figure 7C:
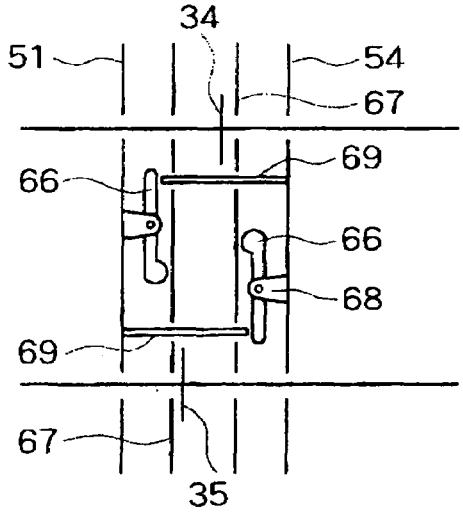

In some embodiments, a quick closing mechanism may be provided; various embodiments of a quick closing mechanism are shown in FIGS. 7*a* through 7*c*. Referring to FIGS. 7*a*–7*c*, embodiments of a quick closing mechanism are shown which comprise at least one lever 66 placed between spring sheet 51 and spring sheet 54. Lever 66 may be pivotally connected to lever mounting 68 at one end such that one end of the lever is fixed or lever 66 may be pivotally connected to lever mounting 68 toward the middle of the lever such that both ends are moveable about the pivot connection. Lever mounting 68 is attached to spring sheet 54. The range of motion of lever 66 is restricted stops 34 and 35. Push rod 69 is attached to opposing spring sheet 51. Note that as used herein the term "push rod" is used to describe rods that either push, or pull, or both. When arms 20*a* and 20*b* are retracted, spring sheets 51 and 54 move toward each other and push rod 69 engages lever 66. As spring sheets 51 and 54 move closer together, lever 66 contacts stop 34 and push rod 69 continues to press upon lever 66. This results in a pulling force being asserted upon lever mounting 68 by lever 66, thereby accelerating the movement of spring sheet 54 toward spring sheet 51. Eventual contact of spring sheet 54 with stop 35 ends the motion of spring sheet 54 toward spring sheet 51. As shown in FIG. 7*c*, the moveable push plates 67 may be provided that are positioned to engage either moveable end of lever 66 when pivotally mounted in the middle.

Positioning apparatus 10 may be introduced into the borehole with arms retracted. In some embodiments, arm pins may be provided. Arm pins may be engaged in certain applications to maintain selected arms in a retracted position while in other applications arm pins may be removed and all arms permitted to expand.

It may be advantageous to provide a preferred breakage point, such as using a shear pin for connector 28, in the event an arm is placed under excessive pressure or positioning apparatus 10 becomes stuck in the hole. Breaking a preferred point would permit a stuck apparatus to be dislodged in the borehole without further damage to the apparatus.

Optional features may be provided in some embodiments. A preferred break point may be included near toward the end of the rod near the arm. Shear pins may be provided as connectors 28 to make preferred break point. In a forced retrieval of a positioning apparatus stuck in the borehole, break point provides a preferential failure location, thereby avoiding arbitrary breakage elsewhere in the positioning apparatus.

The foregoing description of the components provides sufficient background for the explanation of operation of representative embodiments of the invention, which will now be described. The positioning apparatus is introduced into a borehole via a conveyance such as a wireline, slickline, coiled tubing. The positioning apparatus may be provided as separately or in conjunction with a borehole tool.

In the operation, while the apparatus is being lowered into the borehole or being pulled out of the borehole, the rods are retracted, thus causing the arms to be retracted such that they do not contact the borehole walls, thereby reducing drag. When logging the borehole, the push rods are extended and the pad members forced against the borehole wall in good contact therewith.

One embodiment of the present invention is a method of measuring a borehole using a positioning apparatus as a borehole caliper. When the positioning apparatus is deployed into the borehole, arms are retracted. Once the depth of interest has been reached, an extend command is sent to the positioning apparatus in response to which arms are extended. Typically the positioning apparatus will be operated in a non-motorized mode when used as a borehole caliper. As each arm is independently operable, the positioning apparatus of the present invention can be used to provide borehole measurements in non-uniform boreholes. An embodiment of the present invention wherein four or more arms are provided has particular application for in making caliper measurements in both the short axis and the long axis in oval-shaped boreholes. Uses of caliper measurements include estimating borehole volume, estimating cement volume, and correcting for borehole effects in data processing.

Figure 8:
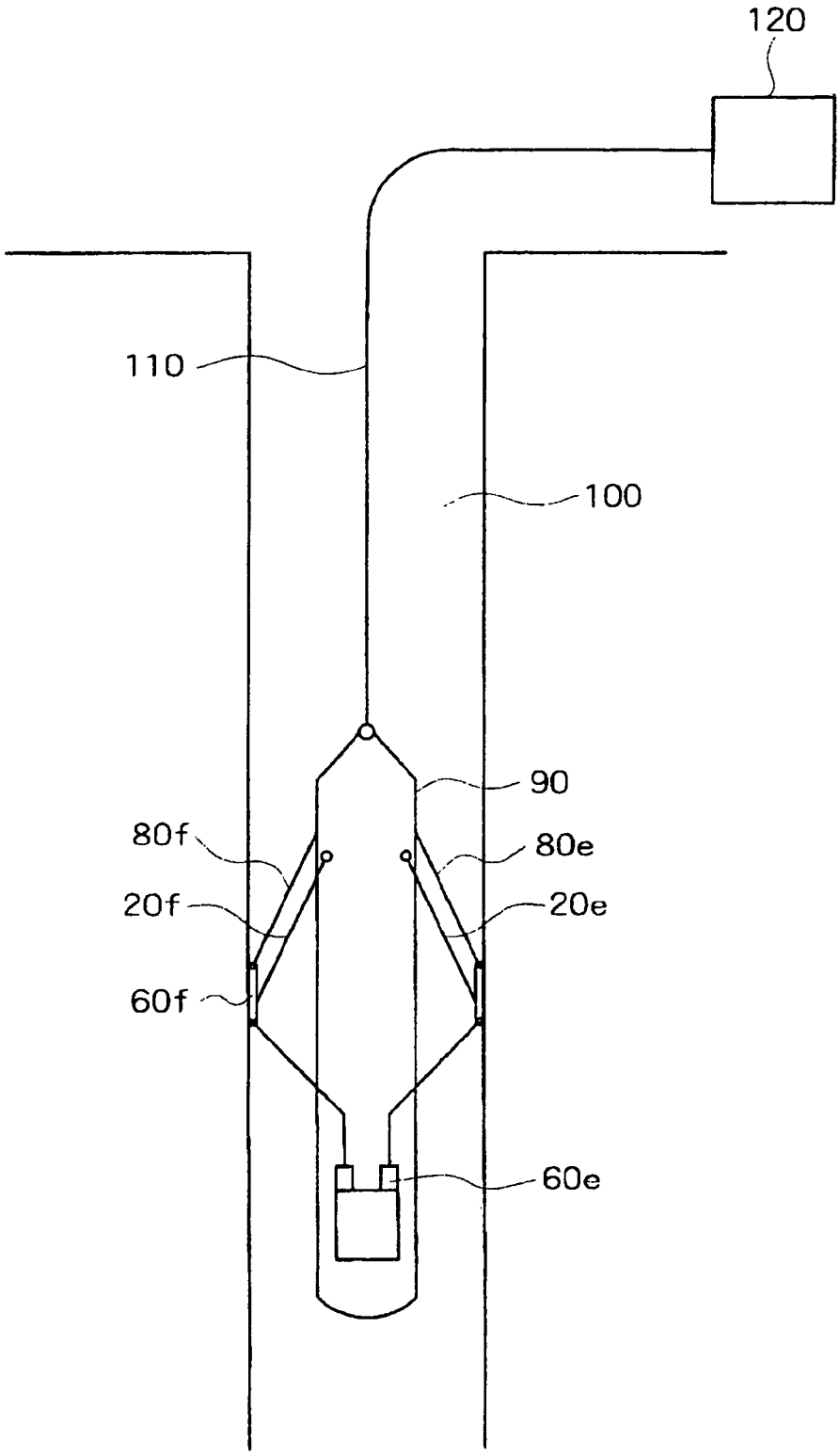
FIG. 8 shows an embodiment of the present invention disposed in a wellbore.

FIG. 8 illustrates a borehole caliper system comprising positioning apparatus 10. Sonde 90 is deployed in wellbore 100 via a conveyance 110. Typical conveyances include drill pipe, wireline, coiled tubing, slick line, or other such methods. Arms 20*e* and 20*f* are extended and link frames 80*e* and 80*f* contact the wellbore perimeter surface as sonde 90 is moved in the borehole. Sensor 60*e* detects the relatively motion of arm 20*e* and sensor 60*f* detects the relative motion of arm 20*f*. Sensors are known capable of readily convert the relative position of arms to an electrical that may be recorded downhole or transmitted to the surface. In this manner, the present invention provides information on the borehole size and relative wall configuration, acting a caliper when moved along the wellbore perimeter surface. Typically the data output of each sensor reflecting the position of each respective caliper arm is recorded as a function of depth in the well. Having a plurality of arms each with an independent sensor outputting data reflecting the position of the arm with depth, the present invention can be used to record a representation of the wellbore cross-section recorded as a function of depth. Surface systems 120 are known which provide such recording capabilities. Uses for such acquired sensor data include borehole compensation calculations during data processing or caliper measurement of the borehole. Borehole caliper measurements are needed for many applications such as cement volume computation.

The present invention has many uses for positioning in a borehole. One method comprises centralizing a borehole tools, such as a sonic tool, in a wellbore. In some applications, a positioning apparatus may be placed above and below the sonic tool. A embodiment comprising a motor is particularly useful for centralizing borehole tools wherein each arm is operated in a motorized mode. The positioning apparatus is introduced into the wellbore with the arms retracted. When the positioning apparatus reaches the depth of interest, the motor is activated by a remote command. The force necessary to extend the arms to contact the borehole in order to centralize the borehole tool may vary depending on the hole deviation, with a greater force required for a hole deviation. The power delivered by the motor to the drive shaft, from which in turn the force is transferred to the rods and arms, can be adjusted via remote command while the positioning apparatus is in the borehole.

As the borehole tool and positioning apparatus traverse the borehole, positional data from the sensor mounted on the apparatus arms is acquired and used to monitor the centralization of the borehole tool in the wellbore. Embodiments of the present invention comprising a quick closing mechanism are particularly useful when a borehole tool is positioned, a measurement taken, and then the borehole tool is positioned in another location. If eccentering is detected, a command for increasing or decreasing the motor power can be given. Typically the motor would provide lower power to the positioning apparatus initially and power would be increased only as needed to center the borehole tool in the wellbore. To encourage good contact with the borehole wall, sensors can be placed on articulated pads.

The independent action of the arms of the present invention is particularly advantageous in deviated wells in that the extension force on the lower arms can be increased to maintain an equal opening angle for each pair of arms in line respectively. Thus the borehole tool can be properly centralized during logging regardless of borehole diameter and deviation.

It can be appreciated that the present invention also provides an apparatus and method for positioning eccentrically in a borehole. In this application, selected arms may be operated in the power mode while other arms operated in a non-powered mode. During deployment into the borehole, the powered arms will be retracted while the non-powered arms may or may not be retracted. When the desired depth in the wellbore had been reached, an extend command will be sent to the powered arms and the arms will be extended using the desired power.

The apparatus of the present invention may be used in methods for short-axis logging. In oval-shaped boreholes, there is a tendency for borehole tools to orient towards the longer axis of the oval shape. To counter this tendency, a larger force can be used on the arms of the present invention that are aligned along the shorter axis of the oval borehole. Alternatively, when the positioning apparatus of the present invention is used in conjunction with a borehole tool that comprises its own positioning arms, the arms of the present invention may be used to position the tool with respect to the long axis of the borehole, thereby permitting the positioning arms of the borehole tool to align with the short axis of the borehole.

Further, a surface operator may use this information to adjust operations in real time. Known communication methods to operate the motor from the surface and known methods to provide power connection to the motor from the surface or other downhole tools are known may be applied to accomplish operational control of the present invention. It is noted that a sensor carrier may be provided on the arms of the present invention in a further embodiment.

The borehole apparatus of the present invention can be used individually, a groups of more than one wherein each embodiment is the same, in groups of more than one wherein the embodiments of the present invention vary, or in combination with other borehole positioning apparatus or borehole tools capable of providing self-positioning in a borehole. For example, a borehole logging system may comprise one borehole apparatus of the present invention used to centralize a sonic tool and another borehole apparatus of the present invention to position a different borehole tool against the wellbore. Similarly the present invention may be used to preferentially position a portion of tool string in combination with other borehole tools that possess self-positioning capabilities. It is also noted that different embodiments of the present invention, such as motorized and non-motorized embodiments may be used in combination in a tool string.

Figure 9A:
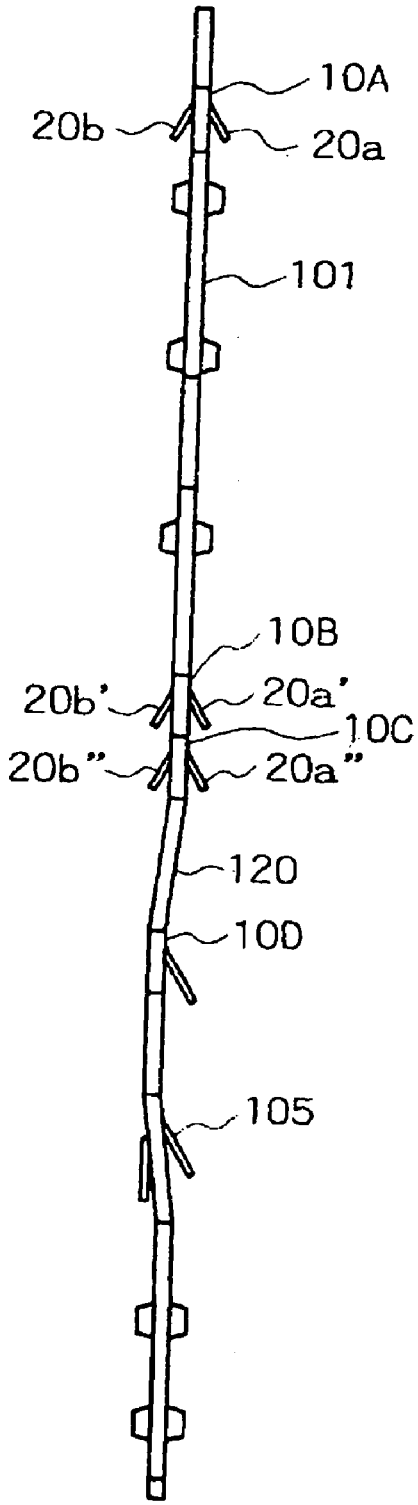
FIGS. 9*a* through 9*d* illustrate use of multiple positioning apparatuses of the present invention in a borehole logging system.
Figure 9B:
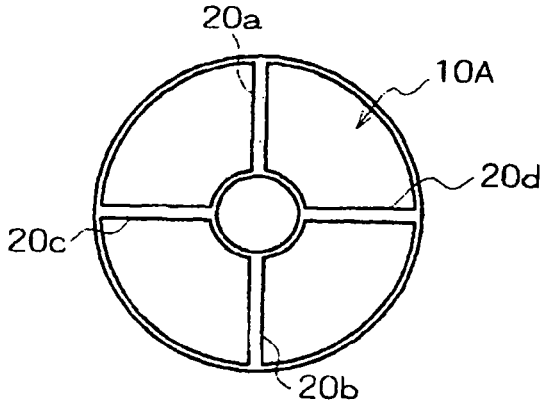

Referring to FIGS. 9*a*–9*d*, an example borehole logging system is shown in which multiple positioning apparatuses 10A, 10B, 10C, 10D are provided for aligning various tools (e.g. density pad tool 105; sonic tool 101) in the borehole in a variety of preferred orientations for both cases of round and oval boreholes. In some embodiments, and as shown in FIG. 9*a*, a knuckle joint 120 may be provided to provide a disjuncture between the various positioning apparatuses. In the case of a round borehole, FIG. 9*a* shows positioning apparatuses 10A and 10B being used as a centralizer, in which arms 20*a*, 20*b*, 20*c*, and 20*d* of 10A, and similar arms for 10B, are placed in a powered position. This provides centralized position for sonic tool 101. However, the some tools, such as density pad tool 105 should be positioned off-center. In cases of round boreholes, apparatus 10D can be used to position the tool off center, by preferentially powering certain arms, while providing advantages over conventional bow-spring eccentralizers, for example due to its ability to selectively retract when passing through narrow sections.

Figure 9C:
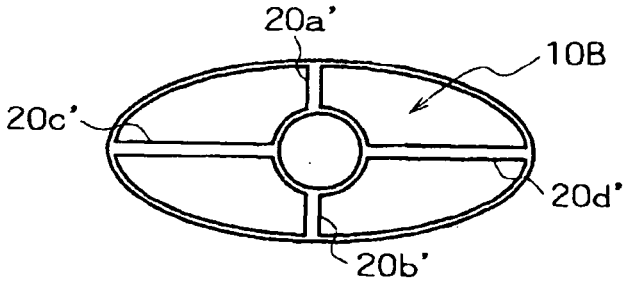
Figure 9D:
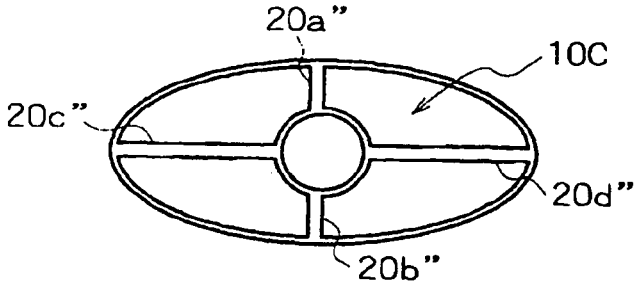

In the case of oval boreholes, a combination of two or more positioning apparatuses are preferably used to correctly position a variety of tools. For positioning sonic tool 101 in an oval borehole both 10A and 10B are preferably operated with all four arms powered. In FIG. 9*c*, apparatus 10B is shown with arms 20*a*', 20*b*', 20*c*' and 20*d*' all powered. In cases in oval borehole it is desirable to log eccentrically on the short axis (for example with density tool 105 logging the short axis in an oval borehole), position apparatus 10C should be operated with one pair of arms in powered mode and the other pair of arms in unpowered mode. In FIG. 9*d*, apparatus 10C preferably is operated with arms 20*c*" and 20*d*" powered, and 20*a*" and 20*b*" unpowered. By operating as described, a substantially greater pressure is generated along one axis which will force that axis to be aligned with the long axis of the borehole. This allows for preferentially aligning a tool, such as density tool 105 with the short axis.

In other configurations, it may be preferable to provide a rotator adaptor joint between positioning apparatuses to align the apparatuses in various orientations with respect to each other. This can provide the functionality, for example, of an eight-arm positioning tool by using two four-arm positioning tools connected by a rotator adaptor set at 45 degree offset.

While particular embodiments of the apparatus of the present invention have been shown and described herein, it is apparent that various changes and modifications may be made to the described apparatus without departing from the scope and spirit of this invention. It is intended that each element or step recited in any of the following claims and each combination of elements is to be understood as referring to all equivalent elements or combinations.

It is claimed:

1. An apparatus for positioning in a borehole comprising a body;

a plurality of arms, each arm independently extendable and independently retractable;

a push rod connected to each arm, each push rod in operational contact with a spring sheet;

a resilient spring mechanism having one end in contact with the spring sheet; and at least one second resilient spring mechanism in operational contact with a push rod, the second resilient spring mechanism having a fixed end.

2. The apparatus of claim 1 wherein the resilient spring mechanism is a coil spring.

3. The apparatus of claim 1 wherein the at least one second resilient spring mechanism comprises a coil spring.

4. The apparatus of claim 1 further comprising at least one position sensor configured to measure the position of at least one push rod.

5. The apparatus of claim 1 further comprising stops whereby arm extension is controlled.

6. The apparatus of claim 1 further comprising at least one sensor at the end of at least one arm.

7. The apparatus of claim 6 wherein the at least one sensor comprises a force sensor.

8. The apparatus of claim 7 further comprising a control system for automatically adjusting the position of an arm based on force sensor measurements.

9. The apparatus of claim 1 further comprising a covering mechanism.

10. The apparatus of claim 9 wherein the covering mechanism is a linkage frame, link arm, leaf spring or bow spring.

11. The apparatus of claim 1 further comprising a relative bearing sensor.

12. An apparatus for positioning in a borehole comprising a body;

a plurality of arms, each arm independently extendable and independently retractable;

a push rod connected to each arm, each push rod in operational contact with a spring sheet;

a resilient spring mechanism having one end in contact with the spring sheet; and a plurality of stops whereby the extension of each arm is independently adjustable.

13. The apparatus of claim 12, wherein the spring sheet comprises a keyway and the push rod comprises a pin, the pin being configured 1) to pass through the keyway when the push rod is rotated to align the pin with the keyway and 2) to not pass through the keyway when the push rod is rotated to not align the pin with the keyway.

14. The apparatus of claim 12 further comprising a resilient subspring mechanism in operational contact with at least one of the first or second push rod, the subspring mechanism having a fixed end.

15. The apparatus of claim 14 wherein the fixed end of the subspring mechanism is fixed to an adjustable position spring sheet.

16. The apparatus of claim 15 wherein the adjustable position spring sheet is in operational contact with a drive rod.

17. An apparatus for positioning in a borehole comprising a body;

a plurality of arms, each arm independently extendable and independently retractable;

a push rod connected to each arm, each push rod in operational contact with a spring sheet;

a resilient spring mechanism having one end in contact with the spring sheet; and at least one of a quick closing and opening mechanism.

18. The apparatus of claim 17 wherein the at least one of the quick closing and opening mechanism comprises at least one lever pivotally connected to a mounting and an opposing push rod for moving the lever about the pivot, wherein the at least one of the quick closing and opening mechanism is positioned to operate upon at least one of the plurality of arms.

19. The apparatus of claim 18 wherein the push rod is provided at a free end of the mounting.

20. An apparatus for positioning in a borehole comprising a body;

a first arm connected to a first push rod in operational contact with a first spring sheet;

a second arm connected to a second push rod in operational contact with a second spring sheet; and a resilient spring mechanism, wherein the first spring sheet contacts one end of the resilient spring mechanism and the second spring sheet contacts the opposite end of the resilient spring mechanism.

21. The apparatus of claim 20 further comprising a resilient subspring mechanism in operational contact with at least one of the first or second push rod, the subspring mechanism having a fixed end.

22. The apparatus of claim 21 wherein the fixed end of the subspring mechanism is fixed to an adjustable position spring sheet.

23. The apparatus of claim 22 wherein the adjustable position spring sheet is in operational contact with a ball nut disposed on a reversible ball screw.

24. The apparatus of claim 23 wherein a motor drives the reversible ball screw thereby moving the ball nut in operational contact with the spring sheet to compress or release the subspring mechanism.

25. The apparatus of claim 20 comprising two first arms operating as a first pair.

26. The apparatus of claim 25 further comprising two second arms operating as a second pair.

27. The apparatus of claim 20 further comprising at least one of a quick closing and opening mechanism.

28. The apparatus of claim 27 wherein the at least one of the quick closing and opening mechanism comprises at least one lever pivotally connected to a mounting and an opposing push rod for moving the lever about the pivot, wherein the at least one of the quick closing and opening mechanism is positioned to operate upon at least one of the first arm and the second arm.

29. The apparatus of claim 28, wherein the push rod is provided at a free end of the mounting.

30. The apparatus of claim 20 further comprising a plurality of stops whereby the extension of each arm is independently adjustable.

31. The apparatus of claim 20 wherein the spring sheet comprises a keyway and the push rod comprises a pin, the pin being configured 1) to pass through the keyway when the push rod is rotated to align the pin with the keyway and 2) to not pass through the keyway when the push rod is rotated to not align the pin with the keyway.

32. An apparatus for positioning in a borehole comprising an elongate body;

a plurality of arms, each arm connected to a separate push rod;

a drive rod;

a motor capable of providing force to The drive rod; and at least one resilient spring mechanism in operational contact with The drive rod and positioned to act upon at least one push rod.

33. The apparatus of claim 32 further comprising at least one second resilient spring mechanism in operational contact with a push rod, the second resilient spring mechanism having a fixed end.

34. The apparatus of claim 33 wherein the spring mechanisms comprise coil springs.

35. The apparatus of claim 32 wherein the resilient spring mechanism acts upon at least one push rod through operational contact with a spring sheet.

36. The apparatus of claim 32 further comprising at least one position sensor configured to measure the position of at least one push rod.

37. The apparatus of claim 32 further comprising stops whereby the extension of the arms is controlled.

38. The apparatus of claim 32 further comprising a plurality of stops whereby the extension of each arm is independently adjustable.

39. The apparatus of claim 32 further comprising at least one sensor at the end of at least one arm.

40. The apparatus of claim 39 wherein the at least one sensor comprises a force sensor.

41. The apparatus of claim 40 further comprising a control system for automatically adjusting the position of an arm based on force sensor measurements.

42. The apparatus of claim 32 further comprising a covering mechanism.

43. The apparatus of claim 42 wherein the covering mechanism is a linkage frame, link arm, leaf spring or bow spring.

44. The apparatus of claim 32 further comprising at least one of a quick closing and opening mechanism.

45. The apparatus of claim 32 further comprising a relative bearing sensor.

46. The apparatus of claim 32 wherein at least one push rod is in operational contact with the drive rod and at least one push rod is not in operational contact with the drive rod.

47. The apparatus of claim 32, wherein the spring sheet a keyway and the push rod comprises a pin, the pin being configured 1) to pass through the keyway when the push rod is rotated to align the pin with the keyway and 2) to not pass through the keyway when the push rod is rotated to not align the pin with the keyway.

48. The apparatus of claim 32 further comprising at least one of a quick closing and opening mechanism.

49. The apparatus of claim 48 wherein the at least one of the quick closing and opening mechanism comprises at least one lever pivotally connected to a mounting and an opposing push rod for moving the lever about the pivot, wherein the at least one of the quick closing and opening mechanism is positioned to operate upon at least one of the plurality of arms.

50. The apparatus of claim 49 wherein the push rod is provided at a free end of the mounting.

51. The apparatus of claim 32 further comprising a resilient subspring mechanism in operational contact with at least one of the first or second push rod, the subspring mechanism having a fixed end.

52. The apparatus of claim 51 wherein the fixed end of the subspring mechanism is fixed to an adjustable position spring sheet.

53. The apparatus of claim 52 wherein the adjustable position spring sheet is in operational contact with a drive rod.

54. A borehole caliper tool comprising an elongate body;

a drive rod;

a motor capable of providing force to the drive rod; and a plurality of arm systems, each arm system comprising an arm capable of being extended outwardly from the apparatus body, pivotally connected to a push rod, the push rod being in contact with a sensor, and a resilient spring mechanism positioned to act upon the push rod and in operational contact with the drive rod.

55. The apparatus of claim 54 wherein the resilient spring mechanism comprises a coil spring.

56. The apparatus of claim 54 wherein the sensor is a position sensor.

57. The apparatus of claim 56 wherein the position sensor is a linear potentiometer or a linear variable differential transducer (LVDT).

58. The apparatus of claim 54 further comprising at least one sensor at the end of at least one arm.

59. The apparatus of claim 58 wherein the at least one sensor comprises a force sensor.

60. The apparatus of claim 54 further comprising recording sensor measurements as a function of depth.

61. The apparatus of claim 54 further comprising a covering mechanism.

62. The apparatus of claim 61 wherein the covering mechanism is a linkage frame, link arm, leaf spring or bow spring.

63. The apparatus of claim 54 further comprising at least one of a quick closing and opening mechanism.

64. The apparatus of claim 54 further comprising a relative bearing sensor.

65. The apparatus of claim 64 further comprising recording relative bearing sensor measurements as a function of depth.

66. An apparatus for use in a borehole comprising:

a plurality of arms; and at least one of a quick closing and opening mechanism comprising at least one lever pivotally connected to a mounting and an opposing push rod for moving the lever about the pivot, wherein the at least one of the quick closing and opening mechanism is positioned to operate upon at least one of the plurality of arms.

67. A method for positioning a tool in borehole comprising the steps of deploying in a borehole an apparatus, the apparatus comprising an elongate body;

a plurality of arms, each arm connected to a separate push rod;

a drive rod;

a motor capable of providing force to the drive rod; and at least one resilient spring mechanism in operational contact with the chive rod and positioned to act upon at least one push rod; activating motor to move drive rod to operationally contact at least one push rod; and moving at least one push rod to extend at least one arm to contact a borehole perimeter surface.

68. A method for measuring a borehole comprising deploying in a wellbore a borehole apparatus comprising an elongate body a drive rod, a motor capable of providing force to the drive rod, and a plurality of arm systems, each arm system comprising an arm capable of being extended outwardly from the apparatus body, pivotally connected to a push rod, the push rod being in contact with a sensor, and a resilient spring mechanism positioned to act upon the push rod and in operational contact with the drive rod, sensing separately an initial position of each arm using a sensor; thereby generating an initial position signal for each arm;

extending the arms to contact a borehole surface;

sensing separately the extended position of each arm using a sensor;

generating an extended position signal for each arm; and processing the initial position signals and the extended position signals to gauge the borehole surface.

* * * * *